US009150044B2

(12) United States Patent
Pencak

(10) Patent No.: US 9,150,044 B2
(45) Date of Patent: Oct. 6, 2015

(54) APPARATUS FOR HOLDING AND DISPLAYING PAGES OF READING MATERIAL

(71) Applicant: W.W. GRAINGER, INC., Lake Forest, IL (US)

(72) Inventor: Thomas Edward Pencak, Franksville, WI (US)

(73) Assignee: W.W. Grainger, Inc., Lake Forest, IL (US)

( * ) Notice: Subject to any disclaimer, the term of this patent is extended or adjusted under 35 U.S.C. 154(b) by 135 days.

(21) Appl. No.: 13/933,637

(22) Filed: Jul. 2, 2013

(65) Prior Publication Data

US 2015/0008661 A1 Jan. 8, 2015

(51) Int. Cl.

| | |
|---|---|
| ***B42F 7/04*** | (2006.01) |
| ***B42F 9/00*** | (2006.01) |
| ***B42D 3/04*** | (2006.01) |
| ***B42D 9/00*** | (2006.01) |
| ***B42D 17/00*** | (2006.01) |

(52) U.S. Cl.

CPC *B42D 3/045* (2013.01); *B42D 9/00* (2013.01); *B42D 9/001* (2013.01); *B42D 17/005* (2013.01); *B42P 2241/02* (2013.01); *B42P 2241/06* (2013.01)

(58) Field of Classification Search

CPC ..... B42F 7/04; B42F 9/00; B42D 9/004; B42D 3/045

USPC ..... 281/45–50; 402/73–78

See application file for complete search history.

(56) References Cited

U.S. PATENT DOCUMENTS

| | | | | |
|---|---|---|---|---|
| 1,728,431 | A | 9/1929 | Mevi | |
| 2,274,993 | A * | 3/1942 | Pearl | 281/46 |
| 2,419,721 | A | 12/1947 | Kopp | |
| 2,784,522 | A * | 3/1957 | Bergman | 281/45 |
| 2,872,252 | A | 2/1959 | Konkle | |
| 3,034,754 | A | 5/1962 | Trindl | |
| 3,057,002 | A * | 10/1962 | Levin et al. | 190/18 R |
| 3,617,074 | A * | 11/1971 | Rigolini et al. | 281/49 |
| 3,635,351 | A | 1/1972 | Homs | |
| 3,653,474 | A * | 4/1972 | Sadow | 190/18 A |
| 4,561,623 | A | 12/1985 | Shepherd et al. | |
| 5,186,497 | A * | 2/1993 | Van Pinkerton, Jr. | 281/49 |
| 5,248,030 | A | 9/1993 | Tarozzi | |
| 5,375,806 | A | 12/1994 | Debus et al. | |
| 5,997,041 | A * | 12/1999 | Tan | 402/46 |
| 6,206,426 | B1 | 3/2001 | Azzato | |
| 6,679,468 | B1 | 1/2004 | Hsu | |
| 6,776,385 | B1 | 8/2004 | Chang | |
| 6,971,621 | B2 | 12/2005 | Gaines | |
| 7,240,887 | B2 | 7/2007 | Buote | |
| 7,731,147 | B2 | 6/2010 | Rha | |
| 7,770,864 | B2 | 8/2010 | Phifer et al. | |
| 8,608,257 | B2 | 12/2013 | Li et al. | |

(Continued)

*Primary Examiner* — Kyle Grabowski

(74) *Attorney, Agent, or Firm* — Greenberg Traurig, LLP

(57) ABSTRACT

A bookholder apparatus adapted to support a plurality of pages of reading material and to be slidable across a support surface includes a front cover, a back cover, and a spine operable coupled to the front cover and the back cover. The bookholder allows the container to be moved between an open position and a closed position, wherein the plurality of pages are supported within the container. A plurality of roller elements are mounted to an outer surface and within a perimeter of at least one of the front cover, the back cover, or the spine to allow the bookholder to slide and/or roll across a support surface.

5 Claims, 5 Drawing Sheets

(56) References Cited

U.S. PATENT DOCUMENTS

2007/0172308 A1* 7/2007 Perella et al. ..... 190/102
2007/0252376 A1 11/2007 Legrand
2008/0093523 A1 4/2008 Dumas
2008/0135713 A1 6/2008 Santoro
2011/0073740 A1 3/2011 Leduc

* cited by examiner

APPARATUS FOR HOLDING AND DISPLAYING PAGES OF READING MATERIAL

CROSS REFERENCE TO RELATED APPLICATION

This application is related to U.S. patent application Ser. No. 13/731,602, entitled "Apparatus for Holding and Displaying Articles," filed Dec. 31, 2012, the contents of which are incorporated herein by reference in their entirety.

FIELD OF THE DISCLOSURE

The present disclosure generally relates to an apparatus for holding and displaying pages of reading material, including for example pages, books, catalogs, manuals, magazines, or the like.

BACKGROUND OF RELATED ART

Books and/or other reading articles, such as for example wholesale, retail and/or industry ordering catalogs, user manuals, etc., are oftentimes heavily used by customers and customer service representatives alike. As such articles may be limited in their production frequency, over time such articles may become easily damaged and worn, especially if the books are large and/or voluminous. Moreover, large books are often unwieldy, difficult to manipulate, and/or difficult to share with others. For example, to share a particular passage of a book with a second user standing in a different position the first user must manually lift, slide, and/or rotate the book. While sliding and/or rolling a large item may be well intended, a typical book cover and/or book support system will likely cause damage to the support surface.

There have been various attempts in the prior art to improve book and/or catalog readability. For example, U.S. Pat. No. 1,728,431 describes a book support that includes a detachable book-supporting device. The supporting device includes relatively foldable elements capable of lying in compact relation against the back of the book cover when not in use as a support for the book.

U.S. Pat. No. 4,561,623 generally describes a telephone book holder having replaceable covers for book of varying thickness. Specifically, a telephone book holder is described which consists of a spine with two groups of parallel channels in its rear surface. Edges of front and rear covers are dimensioned to be slid into respective channels of each group, the edges being connected to the covers by living hinges. Book retaining wires are pivotally connected at the top end of the spine and can be press fitted to the other end to retain a telephone book in position. Top and bottom caps are securable to the ends of the spine to retain the covers and the wires on the spine. The covers can be replaced without requiring removal of the book or complete detachment of the end caps and the thickness of the book to be held is adjustable by sliding the covers into appropriate channels.

U.S. Pat. No. 5,375,806 generally describes a book cover for reliably holding a book in an open position. The holder includes a back plate with tabs thereon for capturing the front and back covers of an open book. A pair of page holders are hingedly mounted on an upper region of the back plate, which are spring-biased into contact with the exposed left and right hand pages of the open book. The page holders are made of transparent material and have smooth surfaces in contact with the book pages so that the latter are easily slid beneath the holders.

U.S. Pat. No. 6,971,621 is directed to a book holder that may be used as a book carrier and may be positionable with an adjustable book holder. In particular, The described book holder essentially comprises a pair of spaced-apart planar book support elements joined by a hinged spine support element that accommodates the book spine. A pair of book holder slope support elements are each joined by a hinge to the top edge of a respective book support element. A closed cord loop element co-operates with the lower extremes of each book support element and each slope support element to vary the reclining slope of the planar book support elements during reading use.

U.S. Pat. No. 7,240,887 relates generally to a book holder that, when open, supports the book for reading and when closed, protects the book. Particularly, a book holder for supporting and protecting an article of reading material is provided. The book holder includes a spine, a pair of cover panels, each of the cover panels is hingedly coupled to the spine to permit the pair of cover panels to be rotated into an open position and to be rotated into a closed position. A page holder assembly is provided to hold the book open and for marking a page.

U.S. Pat. No. 7,731,147 describes a universal bookholder that allows a book to be carried and read in a number of locations. The universal bookholder includes a pair of cover members forming an inner space to receive a book therein. A supporting unit is combined between the pair of cover members so as to be folded with the cover members. A string installed in the supporting unit is configured to traverse papers of the book for fixing the received book, and at least one guide member is mounted in the pair of cover members. A clamp is movably combined to the guide member for fixing a paper of the received book.

Finally, U.S. Application Publication No. 2007/0252376 describes a toy book having a center chassis and wheels for displaying the book in an upright fashion. Specifically, the publication describes a vehicle-shaped book of foam-based pages includes a center chassis page and at least one body page, each page being constructed of a panel of a semi-flexible foam material. The center chassis page and the body pages are bound to adjacent pages thereof in a book format. Front and rear ground-engaging wheels are rotatably mounted on the center chassis page whereby the vehicle-shaped book is rollable on the front and rear ground-engaging wheels.

While the above identified references generally work for their intended purposes of covering and/or displaying a book, the present disclosure, among other things, provides a structure for protecting a reading article, allows for the display and use of the article, provides a carrying device, and allows for the opened article to be easily shared between readers. The disclosed structure may also protect the book, increasing its shelf-life and provide an attractive means of displaying a book in an open or closed position, which is suitable for decorative and/or promotional purposes.

DETAILED DESCRIPTION

The following description of example methods and apparatus is not intended to limit the scope of the description to the precise form or forms detailed herein. Instead the following description is intended to be illustrative so that others may follow its teachings.

Generally, the present disclosure relates to an apparatus for holding and displaying pages of reading material including a book, catalog, manual, magazine, directory, or other similar items having a book-like or page-like structure. While in the present disclosure, the term "book" is often used to describe such objects, it will be appreciated by one of ordinary skill in the art that the described "book" may be any suitable article. For example, in the present disclosure, a book is releasably coupled to a hinged connected book-holding device, which helps to protect and display the book in a closed and/or open arrangement. The device includes a plurality of wheels and/or roller bearings disposed along the outer surface of the device to support the device and book when in the open position and allow the device and book to be moved, rolled, and/or otherwise slid across a support surface.

Figure 1:
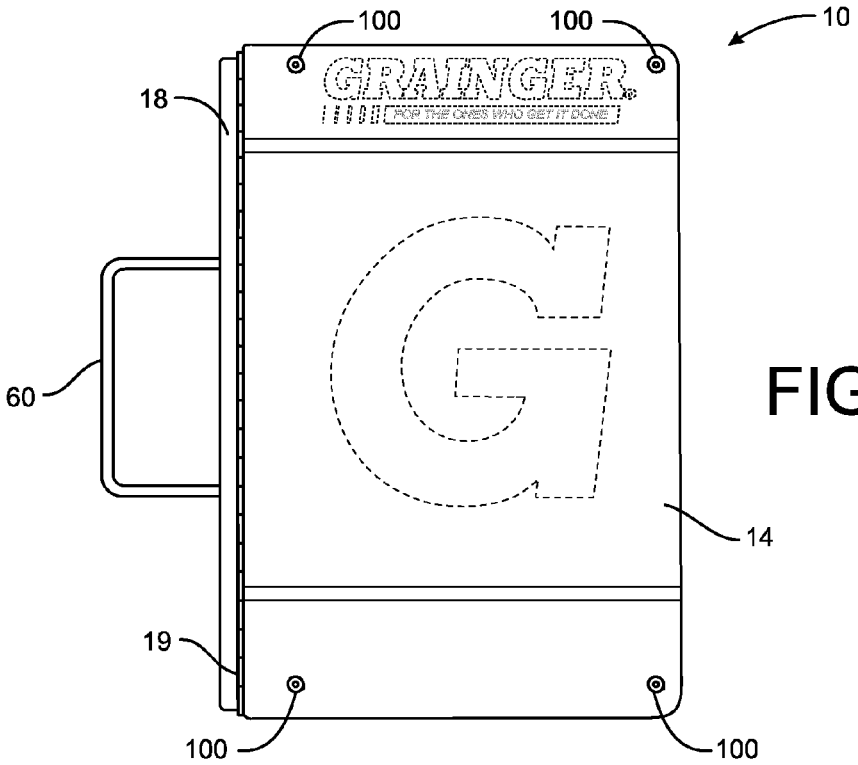
FIG. 1 is a front elevational view of an example apparatus for holding and displaying reading materials.
Figure 2:
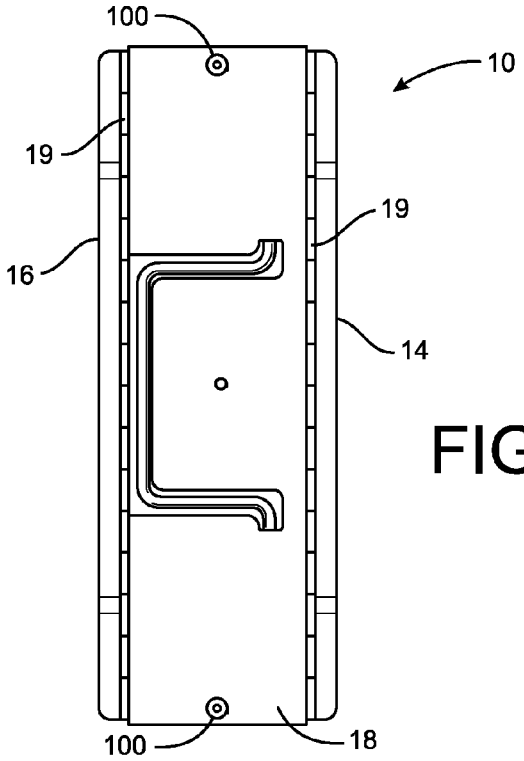
FIG. 2 is a side elevational view of the example apparatus of FIG. 1.
Figure 3:
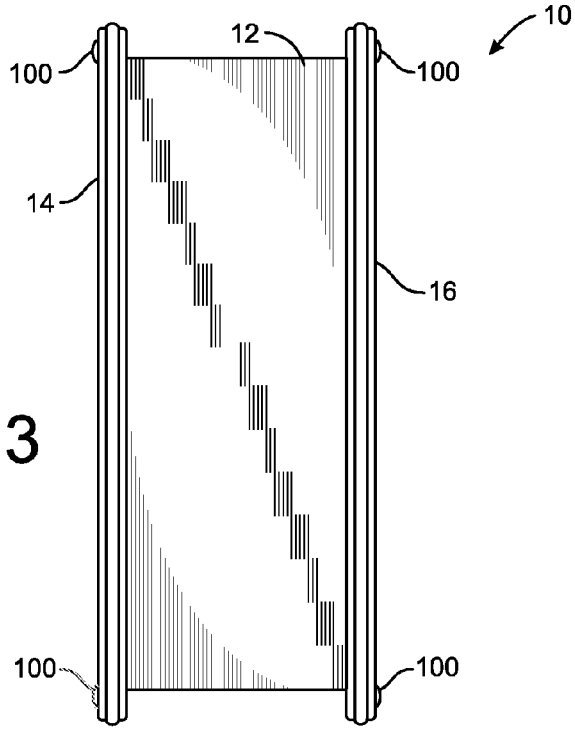
FIG. 3 is an opposite side elevational view of the example apparatus of FIG. 1.
Figure 4:
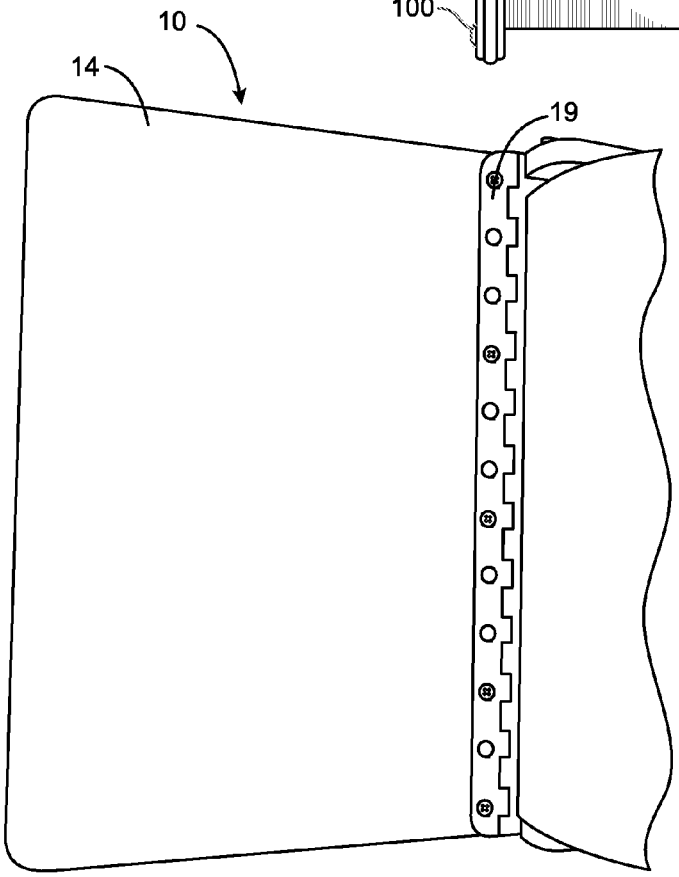
FIG. 4 is a partial front view of the example apparatus of FIG. 1 showing the apparatus at least partially opened.
Figure 5:
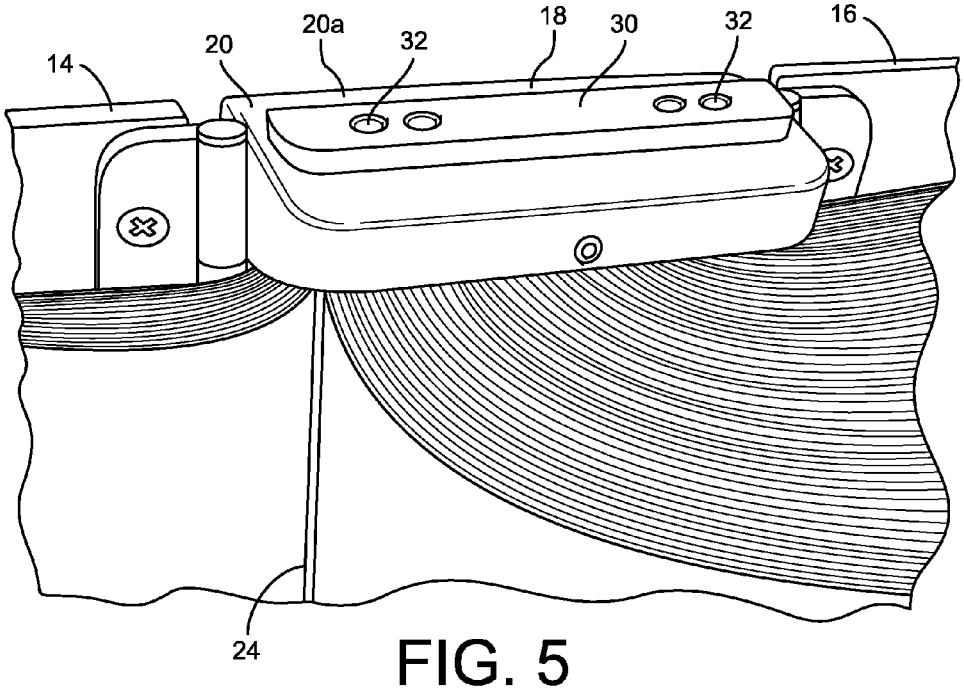
FIG. 5 is a detailed perspective view of one of an example pair of opposed page element holders for releasably retaining pages of reading material within the apparatus of FIG. 1.
Figure 6:
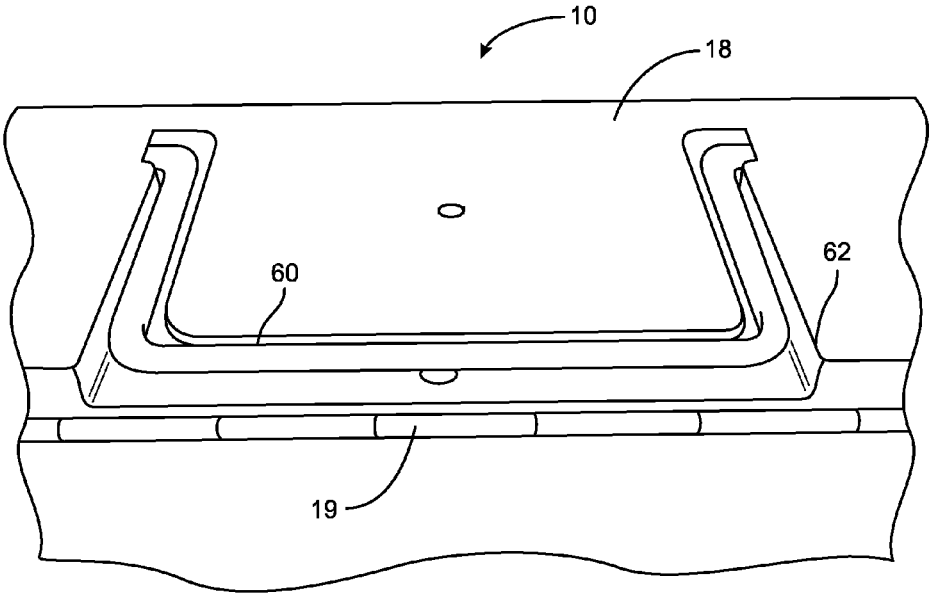
FIG. 6 is a detailed perspective view of an example handle for carrying the example apparatus.
Figure 7:
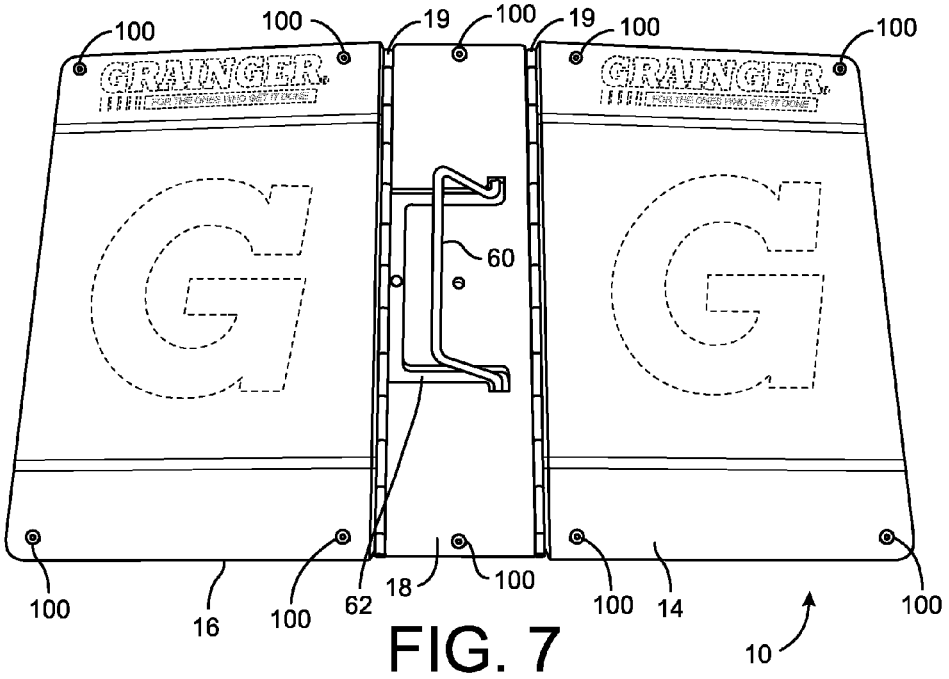
FIG. 7 is a perspective view of the example apparatus of FIG. 1 showing the outer surface of the apparatus in an opened position and with the pages of reading material removed.

Referring now to the figures, an example adjustable apparatus for holding and displaying reading materials is disclosed. In particular, an example apparatus 10, such as a page and/or book holding device is generally described with reference to FIGS. 1-10. Specifically, the figures depict the example apparatus 10 holding pages and/or a large book 12, such as for instance, a large product catalog such as a yearly product catalog in both a closed (FIGS. 1-3) and an opened position (FIGS. 4-5). As will be appreciated by one of ordinary skill in the art, the book 12 may any suitable article including, for instance, a hardcover book, softcover book, textbook, reference book, catalog, manual, telephone book, album, CD-catalog, and/or any other appropriate object having a structure resembling a traditional book and/or page structure.

The example apparatus 10 generally includes a front cover 14, a back cover 16, and a spine 18. The front cover 14 and the back cover 16 are operably coupled to the spine 18 to allow the apparatus 10 to be opened and closed as desired. In some examples, the spine 18 may be reduced and/or effectively eliminated such that only the front cover is directly coupled to the back cover. In this example, however, the covers 14, 16 are coupled to the spine 18 via a piano hinge 19, although any suitable hinge-type arrangement may be utilized. Additionally, in this example, the front cover 14, back cover 16, and spine 18 open such that the apparatus 10 is generally coplanar when in the completely opened position. Accordingly, in this instance, it will be understood that the covers 14, 16, and spine 18, are generally rigid and/or semi-rigid, although each of the covers 14, 16, and the spine 18 may be suitably flexible as desired.

As will be disclosed in further detail below, the example apparatus 10 further includes a plurality of roller elements 100 that are mounted to an outer surface and within an outer perimeter of at least one of the front cover 14, the back cover 16, or the spine 18. The roller elements are placed within the perimeter of the respective cover 14, 16, or spine 18 to allow the container to roll and/or slide across a surface when the apparatus 10 is placed flat on the surface. In this manner, the apparatus 10, and the pages contained therein may be easily shared across a surface, such as a tables, desk, etc., as desired.

In the illustrated example, the apparatus 10 is configured to retain a plurality of pages, such as for instance a book, catalog, etc. In this example, the book 12 is releasably attached to the device 10, and more particularly to the spine 18 via a pair of opposed page element holders 20, which take the form of an upper flange 20*a* and lower flange 20*b* integrally formed with the spine 18 and/or attached thereto and configured to retain the book 12 therebetween. The example page element holders 20 include, for example, at least one rod 24 extending between the two holders 20 (see FIGS. 5, 8, 10). The example rod(s) 24 extend between the upper and lower flanges 20*a*, 20*b* and though the pages and/or spine of the inserted book 12. The rod(s) 24 are thus located a suitable distance from the inner surface of the spine 18 such that the inserted book 12 is retained in the apparatus 10 without being able to be easily slid out or otherwise easily removed from the device 10. Further, in this example, the rod(s) 24 are attached to the respective flanges 20*a*, 20*b* through any suitable means. For instance, in this illustration the rod(s) 24 extend through apertures 26 formed through the upper flange 20*a* and into similarly formed apertures 28 formed in the lower flange 20*b*. In this instance, the apertures 28 do not extend through the flange 20*b*, but rather form a void open to accept and retain the rod 24 therein. The upper aperture 26, meanwhile, does extend through the upper flange 20*a* to allow insertion of the rod 24 therethrough. The rod(s) 24 may be retained in the installed position via any suitable attachment, including for example via a plate 30 secured via fastener 32 to the upper flange 20*b* and preventing the rod(s) 24 from being removed (see FIG. 5).

As will be appreciated by one of ordinary skill in the art, the book 12 may be coupled to the apparatus 10 by any suitable structure. For example, in the present device 10, the upper and/or lower flange 20*a*, 20*b*, may be adjustably mounted to the device 10, and more particularly to the spine 18 such that books of various heights may be selectively retained by the device 10. Still further, the rod(s) 24 may be lengthened, shortened, and/or relocated as desired to accommodate various book heights and/or thicknesses. In addition, the rod(s) 24 may be retained in the apparatus 10 may any appropriate means such as, for example, threading the rod(s) onto the flanges, pivot lock, magnetics, or the like. Finally, when utilized, the plate 30 may similarly use various mechanical means to attach to the device 10, including, for example, a clamping mechanism, screw, friction fit, magnetic attachment, adhesive, hook-and-loop fastener, snap-on feature, quick-release assembly, and/or any other appropriate attachment means.

Still further, in the illustrated example, page element holders 20 attach to the apparatus 10 at the spine 18. However, one of ordinary skill in the art will recognize that the element holders 20 may alternatively and/or additionally attach to the apparatus 10 by either the front cover 14, the back cover 16, and/or any other appropriate location. Additionally, in still further examples, the apparatus 10 may provide a permanent, semi-permanent, rigid or semi-rigid cover that attaches to the book 12.

Figure 8:
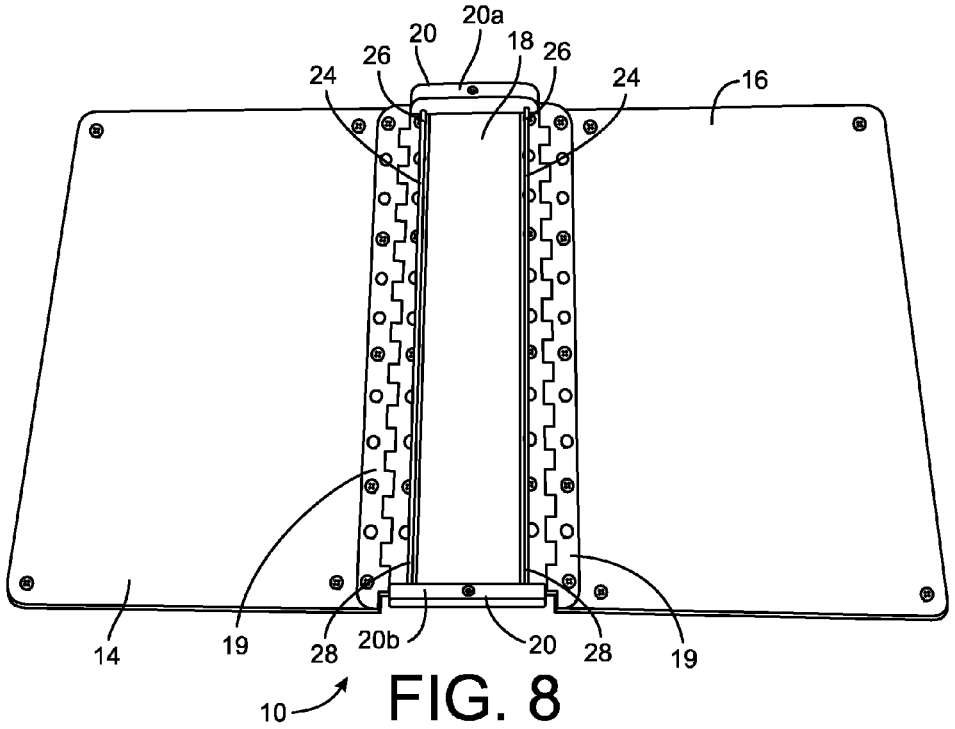
FIG. 8 is a perspective view of the example apparatus of FIG. 1 showing the inner surface of the apparatus in an opened position and with the pages of reading material removed.

As noted above, and as best illustrated in FIGS. 1, 7, and 9, the example apparatus 10 includes a plurality of roller elements 100 mounted to at least one of the covers 14, 16, or spine 18 to allow the apparatus 10 to slide and/or roll across a support surface when the apparatus 10 is placed flat against the support surface on the respective side. In this example, the roller elements 100 are located within the outer perimeter of each of the front cover 14, the back cover 16, and the spine 18, respectively. The number and arrangement of the roller elements 100 within the perimeter of the cover 14, 16 or the spine 18, may vary as desired and may be any suitable arrangement and/or number to allow for a relatively stable placement of the apparatus 10 on the support surface. For instance, as illustrated, the example front cover 14 and back cover 16 each includes four roller elements 100 located in a generally rectangular arrangement with each of the elements 100 being placed proximate to the corner of the respective cover. Meanwhile the example spine 18 includes two roller elements 100 located spaced apart and generally along the center line of the spine 18. With the illustrated arrangement of roller elements 100, the apparatus 10 may be stably supported in a close arrangement on either of the front cover 14 or the back cover 16 (see FIG. 1), and may also be stably supported in a fully opened position on each of the front and back cover 14, 16 and the spine 18 as illustrated in FIG. 8.

Figure 9:
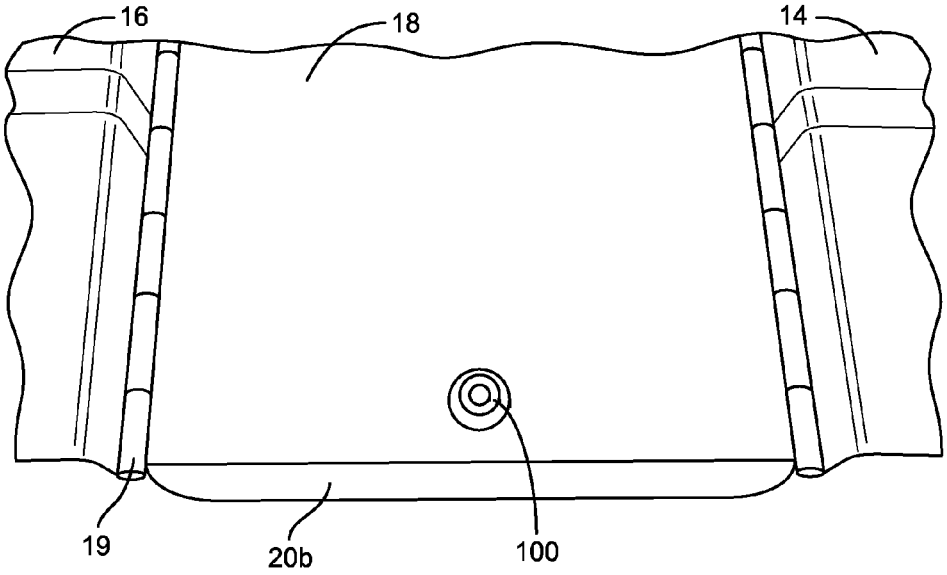
FIG. 9 is a detailed perspective view of an example roller element mounted to an outer surface of the example apparatus of FIG. 1.
Figure 10:
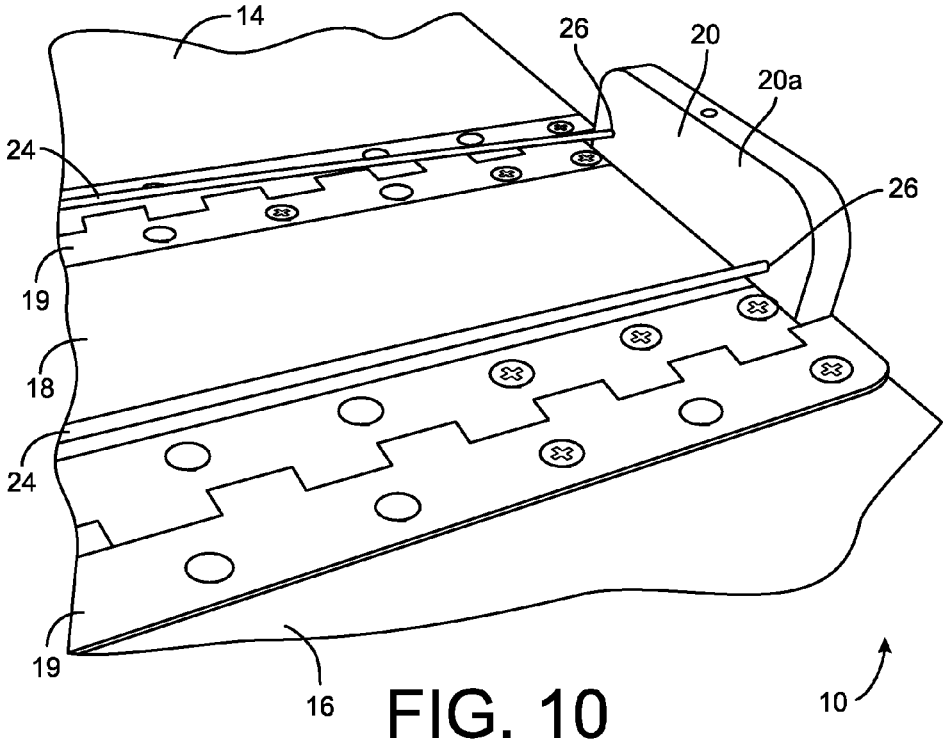
FIG. 10 is a detailed perspective view of one of an example pair of opposed page element holders for releasably retaining pages of reading material within the apparatus of FIG. 1 with the pages of reading material removed.

As shown in FIG. 9, the example roller elements 100 are ball bearing rollers mounted at least partially within (e.g., embedded with) the respective cover 14, 16 or spine 18 to provide to a relatively flush rolling surface and the example roller elements 100 extend generally perpendicular from the outer surface of the respective cover 14, 16, or spine 18. It will be appreciated, however, that the rollers 100 may alternatively be mounted directly to the outer surface of the apparatus 10 as desired. Still further, the roller elements may be any conventional wheel, castor, roller, etc, surface mounted and/or embedded within to provide rolling capability.

In yet another example, the apparatus 10 may include at least one handle 60, such as a pivotal and/or otherwise retractable handle to carry the apparatus 10. In this example, the spine 18 includes a recess 62 (e.g., a channel) that allows the pivotal handle 60 to be stored flush with the outer surface of the spine 18.

While various concepts have been described in detail, it will be appreciated by one of ordinary skill in the art that various modifications and alternatives to those concepts could be developed in light of the overall teachings of the disclosure. For example, it will be appreciated that the apparatus 10 may include identifying markings (e.g., title, volume number, date, owner's name, promotional name, etc.) on various locations, including for example, on the covers 14, 16, or the spine 18, and/or any other appropriate location. Further still, the apparatus 10 may include bookmarks, placeholders, locks, closing mechanisms, etc.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. An apparatus for holding and displaying a plurality of pages of reading material comprising:

a front cover having a first exterior planar surface;

a back cover having a second exterior planar surface;

a spine having a third exterior planar surface coupled to the front cover via a first hinge and to the back cover via a second hinge to allow the container to be moved between an open position in which the first exterior planar surface, the second exterior planar surface, and the third exterior planar surface are placed into alignment and a closed position in which the first exterior planar surface and the second exterior planar surface are generally parallel to each other and generally transverse to the third exterior planar surface, wherein the spine is adapted to securely hold the plurality of pages of reading material; and a plurality of roller elements mounted within at least each of the front cover and the back cover wherein the plurality of roller elements mounted within the front cover extend from the front cover through the first exterior planar surface and the plurality of roller elements mounted within the back cover extend from the back cover through the second exterior planar surface to allow the apparatus to be rolled across a surface in the open and closed positions.

2. An apparatus as recited in claim 1, further comprising a handle moveably mounted to at least one of the front cover, the back cover, or the spine, the handle being movable between a first position in which the handle extends from the at least one of the front cover, the back cover, or the spine and a second position in which the handle is disposed within the at least one of the front cover, the back cover, or the spine interiorly of the respective at least one of the first exterior planar surface, the second exterior planar surface, or the third exterior planar surface.

3. An apparatus as recited in claim 1, wherein the plurality of roller elements are ball bearing rollers.

4. An apparatus as recited in claim 1, wherein the spine is adapted to releasably hold the plurality of pages of reading material.

5. An apparatus as recited in claim 4, wherein the plurality of pages of reading materials are a catalog.

* * * * *